United States Patent [19]

Messner et al.

[11] 4,005,716

[45] Feb. 1, 1977

[54] HAND DEVICE FOR MAKING CIGARETTES

[75] Inventors: Rudolf Messner; Walter Weisser, both of Trossingen, Germany

[73] Assignee: Martin Brinkmann AG, Bremen, Germany

[22] Filed: Feb. 9, 1972

[21] Appl. No.: 224,741

[30] Foreign Application Priority Data

Aug. 5, 1971 Germany ..... 2139242

[52] U.S. Cl. ..... 131/70

[51] Int. Cl.[2] ..... A24C 05/42

[58] Field of Search ..... 131/70, 75

[56] References Cited

UNITED STATES PATENTS

| | | | |
|---|---|---|---|
| 52,842 | 2/1866 | Gassette | 131/70 |
| 562,213 | 6/1896 | Bruandet | 131/70 |
| 3,491,768 | 1/1970 | Paynter | 131/72 |

*Primary Examiner*—John F. Pitrelli

[57] ABSTRACT

A device for manually forming a plug of tobacco and ejecting the plug into a cigarette tube includes a housing defining a chamber for receiving loose tobacco and a press bar for compressing the tobacco into a cylindrical plug. The press bar is slid horizontally in the chamber by means of a toggle lever system including a handle pivotally mounted at one end in the housing, and pivotally connected to the end of the press bar remote from the tobacco by a lever, which is pivotally connected to the handle and press bar. After forming the plug, the latter is ejected by means of a slide including a lug extending into the chamber at one end through a slot. A spoon on the inner end of the lug engages one end of the plug and, by moving the lug along the slot, the plug is forced into a cigarette tube mounted on a tube on one side of the housing.

4 Claims, 3 Drawing Figures

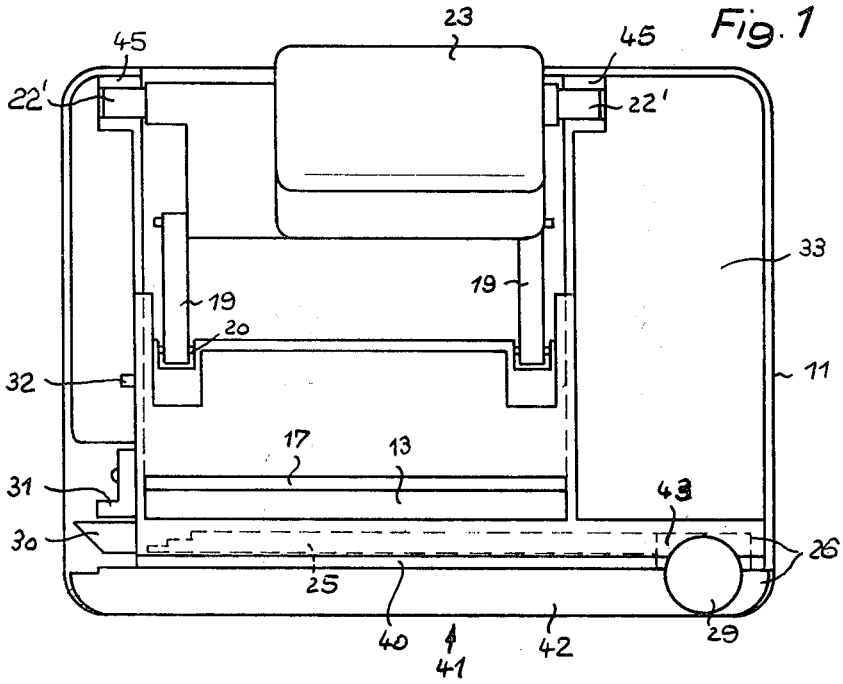
Fig. 1
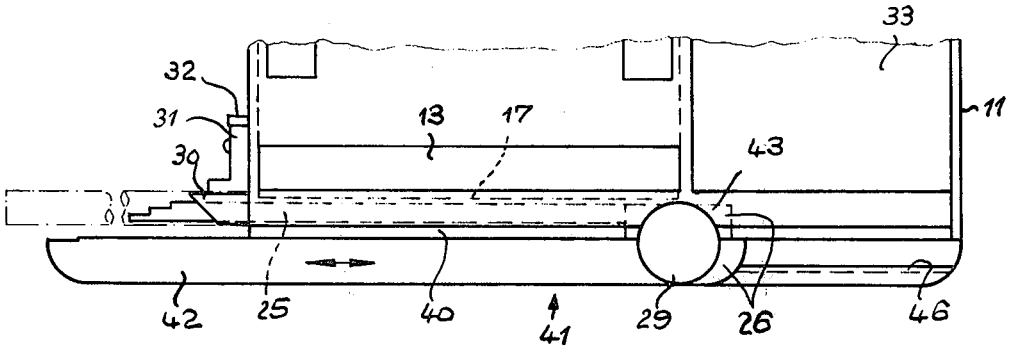
Fig. 2
Fig. 3
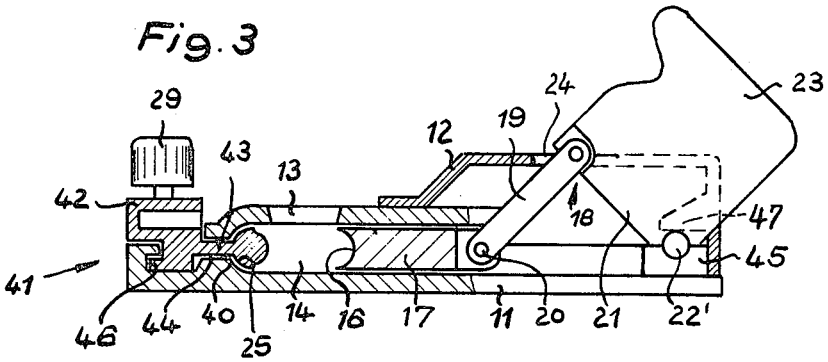

HAND DEVICE FOR MAKING CIGARETTES

This invention relates to a device for manually filling cigarette tubes. More specifically, the invention relates to a device including a chamber for pressing tobacco, a press bar movable horizontally in the chamber at a right angle to the longitudinal axis thereof, a slide for ejecting the tobacco plug, the slide being provided with a spoon and a socket fixed in the housing, for holding the cigarette tubes to be filled. A lever arrangement acts on the press bar to produce the pressing effect.

The object of the present invention is to provide a device for filling cigarette tubes including a lever drive, and which is of simple construction and reliable in operation. Moreover, in an improvement of the device, the cigarettes to be filled are protected against mistakes during the filling operation. The assembly of the device is relatively simple.

According to the invention, the above object is achieved by designing one of the levers of the lever arrangement as an outwardly projecting handle, the guidemotion of which for the production of pressure is approximately at a right angle to the bearing surface of the device, and a central lever arrangment, in its above-dead-centre position, abuts against the bottom of the housing. Because of the lever design, it is possible to hold the device firmly on a table surface with one hand during pressing, so that the other hand remains free for the ejecting of the tobacco plug, etc.

In order to facilitate reliable use of the device, the outer side wall associated with the chamber for pressing tobacco is designed as a double wall including an inner wall portion having an elongated slot, through which the rear end of the ejector slide projects with a lug, the lug being slidingly supported in the elongated slot, and an outer wall portion movable with respect to the inner wall portion only in the direction of ejection and connected to the lug of the ejector slide. Thus, it is assured that the side wall portion, which can be pushed out with the spoon, simultaneously serves as a cover and protection for the tube to be filled. The risk of injury to the hand of the operator is reduced.

In filling devices, the press bar of which is movable by means of a lever system with one lever is designed as a handle projecting outwardly from the housing and having a guide motion during pressing approximately at a right angle to the bearing surface of the housing, the problem of simple construction and assembly is solved with advantage by designing the lever as a handle pivoted with its bearing axis in bearing boxes in the lower portion of the housing, and the bearing itself maintained in position by means of the upper portion of the housing mounted subsequently. Thus, the device can be assembled in a relatively short time, since the cumbersome defining of a separate axis using bearing blocks and levers can be avoided.

An advantageous form of lever and bearing lugs or pins is produced by designing the lever as a handle including a moulded piece of plastic with a cylindrical pivot pin on each side thereof and integral with the moulded handle.

Moreover, the outer side wall of the chamber for pressing the tobacco is so shaped that the outer movable wall portion of such side wall is connected to the lower portion of the housing by means of a dove-tailed or T-shaped guide. Thus, the outer wall portion and the spoon are always in satisfactory alignment.

The invention will now be described in greater detail with reference to the accompanying drawing, wherein:

FIG. 1 is a plan view of a filling device in accordance with the present invention;

FIG. 2 is an enlarged plan view of a portion of the device of FIG. 1; and

FIG. 3 is a cross-sectional view of the device of FIG. 1.

With reference to the drawing, the filling device includes a housing formed by lower and upper portions 11 and 12, respectively. The upper portion 12 of the housing is provided with an elongated opening 13 to a pressing chamber 14. The pressing chamber 14 is defined by a semi-circular wall portion 40, against which a generally semi-dish-shaped spoon 25 abuts and an opposing semi-circular surface 16 of a horizontally movable press bar 17.

The inner wall portion 40 forms part of a side wall 41, which is constructed in the form of a double wall. The outer portion 42 of the double wall 41 is movable with respect to the inner wall portion 40 in the direction of ejection. For this purpose, the outer wall portion 42 includes a lug 43, which projects through an elongated slot 44 in the inner wall portion 40 and is slidingly supported therein. The lug 43 carries the spoon 25. The spoon 25 and the lower wall portion form an ejection slide 26. Moreover, the outer wall portion 42 is connected to the lower housing portion 11 by means of an undercut guide or track 46, so that the parts are maintained in alignment. A handle 29 is provided on the top of the outer wall portion 42.

The end of the press bar 17 remote from the chamber 14 is connected to a lever arrangement 18, which acts towards the bottom of the housing, and which includes first levers 19 pivotally connected to the bar 17 for rotation about an axis defined by a pin 20, and a second lever 21 pivotally connected to the lower portion 11, of the housing for rotation about a horizontal axis defined by pins 22', which are aligned with the longitudinal axis of the press bar 17. The lever 21 includes a handle portion 23, and can be made as a moulded piece of plastic, the pivot pins 22', which serve as the axis of the lever, being moulded integrally with the lever 21. The pins 22' are mounted for rotation in arcuate recesses in bearing boxes 45, and are retained therein by a projection 47 on the upper housing portion.

In order to guide the press bar 17, which is movable transversely to the longitudinal axis of the opening 13, the two levers 19 are pivotally connected to the press bar in parallel, spaced apart relationship. The handle 23 bridges the gap between the two levers 19 and projects outwardly through an opening 24 in the upper housing portion 12.

In the ejection direction, a cylindrical tube 30 is provided on one side of the housing. A paper cigarette tube can be pushed onto the tube 30 and held by means of a flexible jaw 31, which is tiltable in the longitudinal direction of the tubes. A pin 32 is provided on the jaw 31 for controlling the jaw 31 as a function of the position of the press bar 17, i.e., when the bar 17 is moved forward by actuating the handle 23, the pin 32 also moves forward to bear against the jaw 31.

An opening 33, which may serve as a container for tobacco or cigarette paper tubes, is provided adjacent to both the chamber 14 and the lever arrangement 18. The opening 33 may be covered by means of a separate cap (not shown).

In operation tobacco is placed in the chamber 14 and the lever system 18 is actuated by pressure on the handle 23 approximately at right angles to the bearing surface of the housing. Thus, the tobacco is pressed by the press bar 17 against the spoon 25 and a plug is formed. In moving from top to bottom, the lever system 18 swings above its dead-centre position, while the press bar 17 is withdrawn by a small amount and the tobacco plug is released. The lever maintains itself in this position.

The released tobacco plug is then ejected by means of the ejector slide 26 by movement of movable outer wall portion 42, the spoon 25 connected thereto and the lug 43 into a paper tube on the tube 30.

If the handle 23 is again pulled up, the press bar 17 is moved to its initial position. The paper tube is released and can be removed from the tube 30 with the tobacco filling.

What is claimed is:

1. A device for manually filling cigarette tubes with a plug of tobacco comprising a housing having upper and lower portions, said housing defining a chamber for receiving loose tobacco; a press bar movably mounted in said housing for movement horizontally at a right angle to the longitudinal axis of the chamber between a first position to the rear of said chamber and a second position compressing the tobacco to form a plug; a toggle lever system for actuating said press bar including a pair of parallel spaced first levers each pivotally connected at one end opposite longitudinal ends of said press bar adjacent the bottom of the lower housing portion, and a second lever arranged between said first levers and pivotally connected to the other end of the first levers and to the bottom of said lower housing portion at a distance from said press bar to permit said press bar to move between said first and second position said second lever defining a handle projecting out of said housing and positioning the connection between the first and second levers for manual actuation, substantially at a right angle to the direction of movement of said press bar; said lower housing portion including bearing boxes for pivotally supporting said handle, said upper housing portion including an interior projection for retaining said handle in said bearing boxes, a slide for ejecting the tobacco plug including a spoon in said chamber and a tube mounted in one side of said housing at the discharge end of said chamber for holding a tube to be filled with a plug of tobacco.

2. A device according to claim 1, wherein said handle is formed of moulded plastic and includes a lower portion and a pair of pivot pins integral with said lever portion for mounting in said bearing boxes.

3. A device for manually filling cigarette tubes with a plug of tobacco comprising a housing having upper and lower portions defining a chamber for receiving loose tobacco; a press bar movably mounted in said housing for movement horizontally at a right angle to the longitudinal axis of the chamber for compressing the tobacco to form a plug; a toggle lever system for actuating said press bar, a slide for ejecting the tobacco plug including a spoon in said chamber and a tube mounted in one side of said housing at the discharge end of said chamber for holding a tube to be filled with a plug of tobacco, one of said housing portions comprising a double wall including an inner wall section and a separable outer wall section, and a slot formed in said inner wall section; said slide including a lug and a spoon integral with said lug extending between said wall portions into said chamber, said lug being slidably mounted in said slot of said inner wall section and connected to said outer wall section, said outer wall section being slidable relative to the inner wall portion for moving said lug and spoon to eject a plug of tobacco.

4. The device according to claim 3 wherein said toggle system comprises a pair of parallel spaced first levers each pivotally connected at one end opposite longitudinal ends of said press bar adjacent the bottom of the housing, and a second lever arranged between said first levers and pivotally connected to the other end of the first levers and to the bottom of said housing at a distance from said press bar to permit said press bar to move between first and second positions, said second lever defining a handle projecting out of said housing and positioning the connection between the first and second levers for manual actuation substantially at a right angle to the direction of movement of said press bar.

* * * * *